United States Patent [19]

Ozeki et al.

[11] Patent Number: 5,061,937

[45] Date of Patent: Oct. 29, 1991

[54] ARRAY ANTENNA APPARATUS

[75] Inventors: Takeshi Ozeki, Kawaguchi; Masanori Matsumura; Jun Tanaka, both of Yokohama, all of Japan

[73] Assignee: Kabushiki Kaisha Toshiba, Kawasaki, Japan

[21] Appl. No.: 460,999

[22] Filed: Jan. 4, 1990

[30] Foreign Application Priority Data

Jan. 20, 1989 [JP] Japan ..... 1-11626

[51] Int. Cl.[5] ..... H01Q 3/22; H01Q 3/24

[52] U.S. Cl. ..... 342/372; 342/368

[58] Field of Search ..... 342/372, 377, 371, 368

[56] References Cited

U.S. PATENT DOCUMENTS 4,258,363 3/1981 Bodmer et al. ..... 342/368

4,814,773 3/1989 Weschberg et al. ..... 342/368

FOREIGN PATENT DOCUMENTS 0023427 2/1980 Japan ..... 342/371

OTHER PUBLICATIONS

B. D. Nordwall, "Ultra-Reliable Radar Technology to Benefit ATF Program", Aviation Week & Space Technology, Jun. 27, 1988, pp. 67-69.

Wallington et al., "Optical Techniques for Signal Distribution in Phased Arrays", 645 G.E.C. Journal of Research, 2(1984), No. 2, London, Great Britain.

*Primary Examiner*—Gregory C. Issing

*Attorney, Agent, or Firm*—Cushman, Darby & Cushman

[57] ABSTRACT

An array antenna apparatus having plural antenna elements includes a control signal generator which generates a control signal including signal generating data and signal controlling data. Each of plural dividers corresponding to the plural antenna elements divides the control signal into the signal generating data and the signal controlling data. Each of plural signal generators corresponding to the plural antenna elements generates a defined signal corresponding to the signal generating data. Also, each of plural drivers corresponding to the plural antenna elements produces a specified signal, corresponding to the defined signal and the signal controlling data, through each of the antenna elements.

29 Claims, 5 Drawing Sheets

ARRAY ANTENNA APPARATUS

BACKGROUND OF THE INVENTION

1. Field of the Invention

This invention relates to an antenna arrangement having plural antenna elements. More specifically, the invention relates to an array antenna particularly suitable for a pulse radar active phased array system, or the like which electronically scans during transmitting-/receiving.

2. Description of the Related Art

A known array antenna arrangement is shown in FIG. 5 (PRIOR ART). This particular antenna arrangement is for an active phased array pulse radar. A signal source 51 generates high frequency carrier signals during a predetermined period of time and having a constant pulse repetition rate which are the transmitting signals. The transmitting signals are distributed to plural transmitting/receiving modules 53 (shown as modules 53-1 to 53-N in the drawings) by a distributor 52. Each of modules 53 has the same configuration. A module 53 includes a phase shifter 54, a high power amplifier 55, a duplexer 56 and a low noise amplifier 57. The phase shift of phase shifter 54 is controlled by an external phase control signal.

Operation in either a transmission mode or a reception mode is selected by a transmitting/receiving control signal which is supplied to duplexer 56 from an external source. During transmission mode operation, the phase of the transmitting signal is controlled by phase shifter 54 which provides high power amplifier 55 with an output signal. Amplified signals from respective high power amplifiers 55 are supplied to an antenna element 58*s* (shown as elements 58-1 to 58-N in the drawings) through respective duplexers 56 in each of transmitting/receiving modules 53. Antenna elements 58 radiate electromagnetic waves forming beam patterns in accordance with the control of the phases of the respective transmitting signals by phase shifters 54.

During reception mode operation, high frequency signals received by antenna elements 58 are supplied to low noise amplifiers 57 through duplexers 56 in transmitting/receiving modules 53. Low noise amplifiers 57 supply amplified signals to receiving modules 59 (shown in the drawings as modules 59-l to 59-N). First and second oscillators 60 and 61 generate first and second local oscillating signals L1 and L2 which are supplied to distributors 62 and 63 for high frequencies. First and second local oscillating signals L1 and L2 having different frequencies are distributed to receiving modules 59 by distributors 62 and 63. A frequency of the amplified signal from low noise amplifier 57 is converted into an intermediate frequency corresponding to the difference between the received frequency and the frequency of first local oscillating signal Ll. Also, the intermediate frequency of a converted signals is converted into a low frequency between the intermediate frequency and the frequency of second local oscillating signal L2. A low frequency signal is converted into a digital signal which is supplied to a systolic array processor 64 from each of receiving modules 59. Systolic array processor 64 processes digital signals for digital beam forming and forms defined received beam. Targets can be detected by computing received data from systolic array processor 64.

In the known apparatus, transmitting signals and local oscillating signals must be distributed by large and weighty distributors 52, 62 and 63 which are used for high frequency signals. This makes the apparatus large and weighty. Also, transmitting/receiving circuits become complicated because of many signal cables for transmitting the high frequency signals. Moreover, it is difficult to carry out phase adjustment between transmitting/receiving modules.

SUMMARY OF THE INVENTION

It is an object of the present invention to provide an improved apparatus without distributors for high frequency signals.

It is a further object of the present invention to provide a more simple and lighter apparatus.

It is still a further object of the present invention to simplify the adjustment of transmitting/receiving circuits of the apparatus.

To achieve the above objects and in accordance with the purpose of the invention, as embodied and broadly described herein, the invention provides an array antenna apparatus having plural antenna elements. A control signal having signal generating data and signal controlling data is generated. Plural dividers correspond to the plural antenna elements. Each of the dividers divides the control signal into the signal generating data and the signal controlling data. Plural generators correspond to the plural antenna elements. Each of the generators generates a defined signal corresponding to the signal generating data. Also, plural drivers correspond to the plural antenna elements. Each of the drivers produces a specified signal, corresponding to the defined signal and the signal controlling data, through each of the antenna elements.

BRIEF DESCRIPTION OF THE DRAWINGS

The present invention will be explained in further detail with reference to accompanying drawings in which.

DETAILED DESCRIPTION OF THE PREFERRED EMBODIMENT

Figure 1:
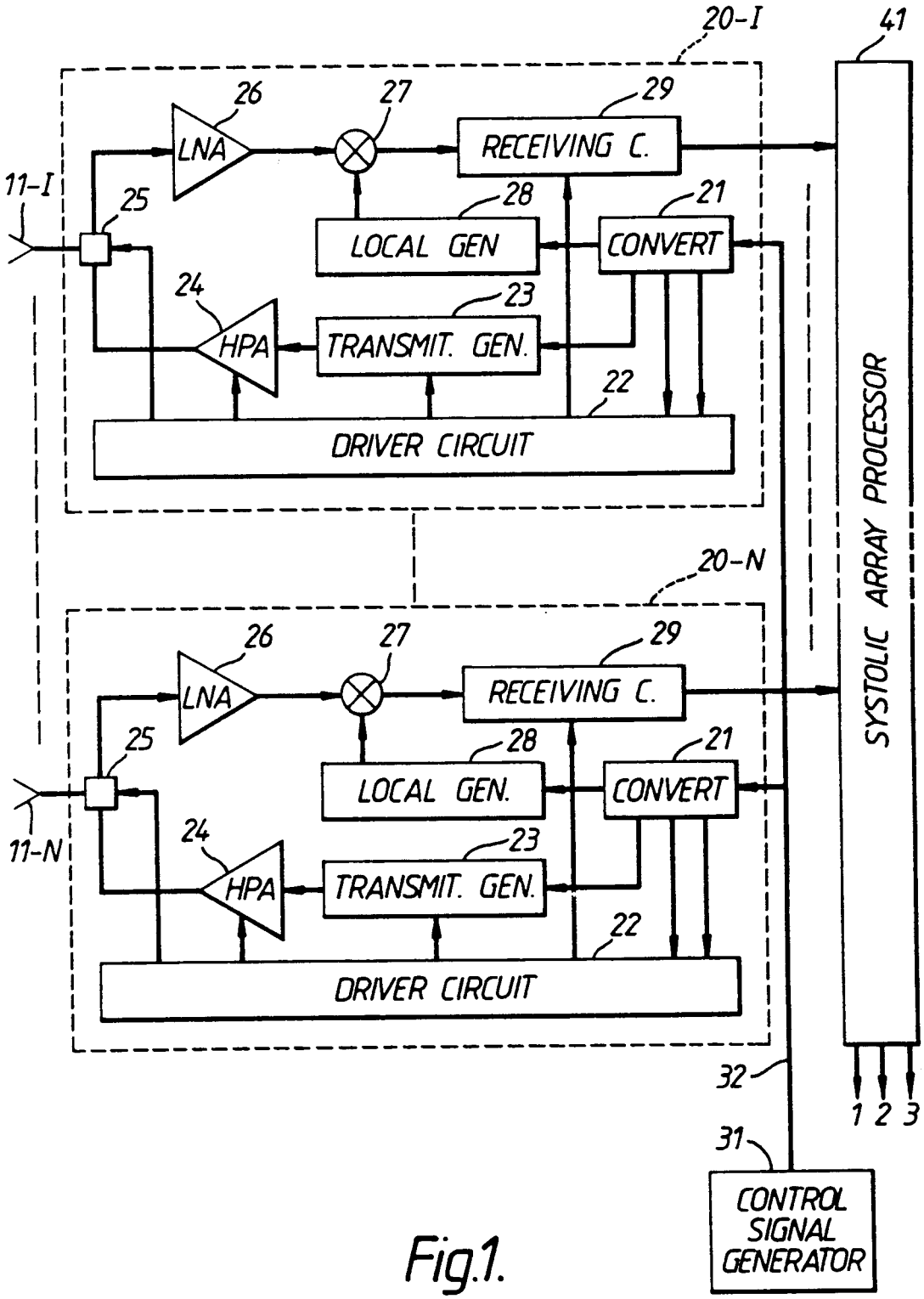
FIG. 1 is a block diagram of an apparatus according to an embodiment of this invention.

Referring to the accompanying drawings, an embodiment of the present invention will be described. The same numerals are applied to similar elements in the drawings, and therefore detailed descriptions thereof are not repeated.

As shown in FIG. 1, an array antenna apparatus, which is used in a pulse radar, includes plural antenna elements 11 (shown in the drawings as elements 11-1 to 11-N), transmitting/receiving modules 20 (shown in the drawings as elements 20-1 to 20-N), and a control signal generator 31. Transmitting/receiving modules 20 have the same configuration.

Figure 2:
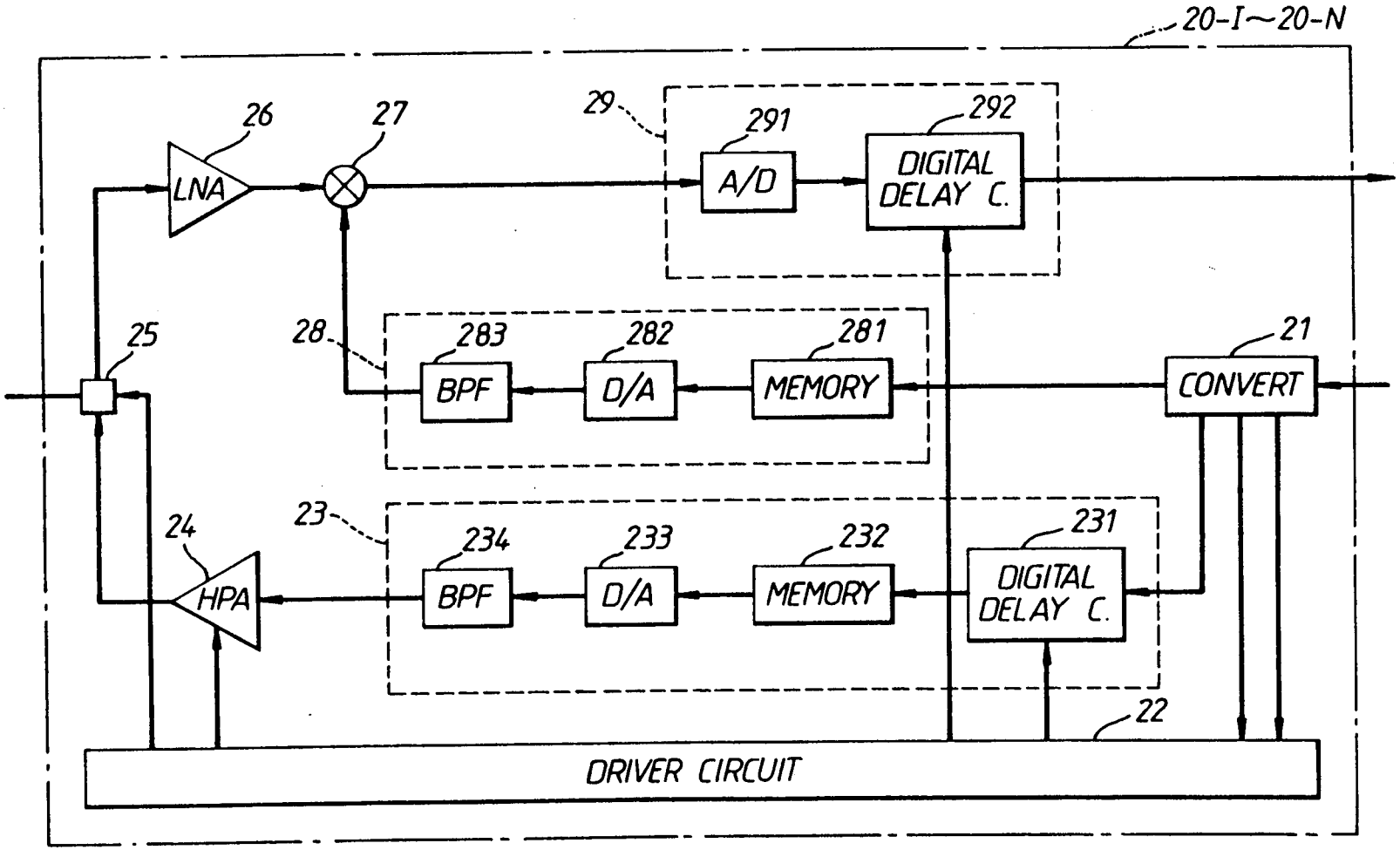
FIG. 2 is a block diagram of a transmitting/receiving module shown in FIG. 1.

Each of modules 20 includes a photoelectric converter 21, a driver circuit 22, a transmitting signal generator 23, a local signal generator 28 and a receiving circuit 29. Block diagrams of signal generators 23 and 28 and receiving circuit 29 are shown in FIG. 2.

Control signal generator 31 carriers out several functions. Control signal generator 31 generates signal generating data including a clock signal with a high frequency generated during transmitting/receiving period or single pulse signal. Also, control signal generator 31 generates phase controlling data for each of transmitting/receiving modules 20, and transmitting/receiving controlling data. Control signal generator 31 also converts the signal generating data, the phase controlling data and transmitting/receiving controlling data into optical signals for producing optical multiplex signals.

Photoelectric converter 21, which is connected to control signal generator 31 through optical fiber 32, converts the optical multiplex signals into electrical signals for producing divided signals. The divided signals correspond to the signal generating data, the phase controlling data and transmitting/receiving controlling data.

The signal generating data include transmitting signal generating data which is supplied to transmitting signal generator 23*v* and local signal generating data which is supplied to local signal generator 28. The divided signals corresponding to the phase controlling data and the transmitting/receiving controlling data are supplied to driver circuit 22. Driver circuit 22 transmits a generating timing signal, corresponding to the phase controlling data of the transmitting system, to transmitting signal generator 23. Also, driver circuit 22 transmits an output timing signal, corresponding to the phase controlling data of the receiving system, to the receiving circuit 29. A high power amplifier 24 is provided with ON/OFF control signal, corresponding to the transmitting/receiving controlling data, from driver circuit 22. Also, a duplexer 25 is controlled by selecting signal, corresponding to the transmitting/receiving controlling data for selecting the transmission or the reception, from driver circuit 22.

As shown in FIG. 2 transmitting signal generator 23 includes a digital delay circuit 231, a memory 232, a digital to analog converter 233 and a band pass filter 234. Digital delay circuit 231 supplies clock signal corresponding to the transmitting signal generating data to memory 232 in accordance with the generating timing signal from driver circuit 22. When the transmitting signal generating data is a single pulse, the clock signal is generated during pulse transmitting time.

Memory 232, which forms such as a read only memory (ROM), stores sampling data of the transmitting signal. The sampling data are read in response to the clock signal. Digital to analog converter 233 converts the digital signal, corresponding to the sampling data from memory 232, into an analog signal which is supplied to band pass filter 234.

The transmitting signal having a defined frequency is produced by the action of band pass filter 234. The transmitting signal from transmitting signal generator 23 is amplified by high power amplifier 24 to produce an amplified signal which is supplied to appropriate antenna elements 11 via duplexer 25.

Local signal generator 28 includes a memory 281 such as a ROM which stores sampling data of a local signal. The sampling data is read in accordance with the local signal generator data, which is a clock signal, from photoelectric converter 21. When the local signal generating data is a single pulse, the clock signal is generated during a receiving time. Digital to analog converter 282 converts a digital signal, corresponding to the sampling data from memory 281, into an analog signal which is supplied to band pass filter 283. The local signal having a defined frequency is produced by the action of band pass filter 283. The local signal from local signal generator 28 is supplied to a mixer 27. If necessary, a phase shifter for compensating the phase of the local signal can be employed in local signal generator 28.

A received signal from an antenna element 11 is amplified by a low noise amplifier 26 through duplexer 25. Mixer 27 produces an intermediate frequency (IF) signal having a frequency corresponding to the difference between the frequencies of the local signal and the received signal. The IF signal is supplied to receiving circuit 29 which includes an analog to digital converter 291 and a digital delay circuit 292 such as a shift register.

Analog to digital converter 291 converts the IF signal to a digital signal which is supplied to a digital delay circuit 292. Digital delay circuit 292 produces a digital received signal in accordance with the output timing signal from driver circuit 22. Digital delay circuit 292 could be formed by a digital filter or by other equivalent means. Digital received signals from transmitting-/receiving modules 20 are transmitted to a systolic array processor 41 which can be formed by a fast fourier transformer or by equivalent means.

During transmission mode operation, control signal generator 31 produces optical multiplexed signals including the transmitting signal generating data corresponding to a transmitting frequency, the phase controlling data of the transmitting system and the transmitting controlling data.

The optical multiplexed signals are separated into n signals for transmitting to each of transmitting /receiving modules 20 through optical fiber 32. Optical signals are converted into electrical signals by photoelectric converter 21. The electrical signal corresponding to the transmitting signal generating data is supplied to transmitting signal generator 23. Also, the electrical signals corresponding to the phase controlling data of the transmitting system and the transmitting controlling data are supplied to driver circuit 22.

Driver circuit 22 produces the generating timing signal corresponding to the phase controlling data. The sampling data of the transmitting signal stored in memory 232 are read in accordance with output clock signals, corresponding to a transmitting frequency, from digital delay circuit 231 with its output timing controlled by the generating timing signal. Thus, a digital signal from memory 232 corresponds to transmitting signal. An analog transmitting signal is produced through digital to analog converter 233 and band pass filter 234. Also, the phase of the transmitting signal from transmitting signal generator 23 can be controlled by the generating timing signal. High power amplifier 24 is set to ON in response to the electrical signal corresponding to the transmitting controlling data during a transmitting period. Also, duplexer 25 is selected on the side of transmission by the electrical signal corresponding to the transmitting controlling data. Therefore, antenna elements 11 radiate electromagnetic waves forming defined beam patterns which can be varied by the phase control of the transmitting signal.

During receptron mode operation, control signal generator 31 produces optical multiplex signals including the local signal generating data corresponding to a local signal frequency, the phase controlling data of the receiving system and the receiving controlling data. The optical multiplex signals are separated into n signals for being transmitted to each of the transmitting/receiving modules through optical fiber 32.

Optical signals are converted into electrical signals by photoelectric converter 21. The electrical signal corresponding to the local signal generating data is supplied to local signal generator 28. Also, the electrical signals corresponding to the phase controlling data of the receiving system and the receiving controlling data are supplied to driver circuit 22. Driver circuit 22 produces the output timing signal corresponding to the phase controlling data. The output timing signal controls the phase of the received signal in digital delay circuit 292.

Duplexer 25 is set for reception operation by an electrical signal corresponding to the receiving controlling data. During such operation, high power amplifier 24 is set to OFF in response to the electrical signal corresponding to the receiving controlling data. Therefore, the received signal from each of antenna elements 11 is amplified by low noise amplifier 26 through duplexer 25. The amplified signal is supplied to mixer 27. Also, the sampling data of the local signal stored in memory 281 are read in accordance with the clock signal, corresponding to the local signal frequency, from photoelectric converter 21.

Digital signals corresponding to the sampling data are converted into analog signals by digital to analog converter 282. The analog signals are supplied to band pass filter 283 for producing the local signal with a defined frequency. Mixer 27 converts the amplified signals with a high frequency into the IF signals with an intermediate frequency. The IF signals are converted into digital signals by analog to digital converter 291. The digital signals are supplied to digital delay circuit 292. Output timing of digital delay circuit 292 is controlled by the output timing signal from driver circuit 22. This control corresponds to the control of the phase of the received signal from each of antenna elements 11. Output signals from digital delay circuit 292 are supplied to systolic array processor 41 which performs digital beam forming (DBF) processing for forming a defined received beam. Targets can be detected by processing of output signals (the number of beams) from systolic array processor 41.

Each of transmitting/receiving modules 20 includes transmitting signal generator 23 and local signal generator 28 which can generate the transmitting signal and the local signal by signal generating data from photoelectric converter 21. This is accomplished without the need for large and weighty signal distributors for high frequency signals. Therefore, the invention provides an arrangement that is structurally simple and light weight.

Simple clock signals with high frequencies and data signals are transmitted to each of modules 20. Thus, the circuitry is simple compared with known arrangements. Also, signal transmission with high reliability is possible. The phase of the transmitting signal is controlled without phase shifters in modules 20. Thus, modules 20 can be relatively simple. Moreover, adjustment of the phase of the received signals is performed by changing the phase controlling data. This simplifies the phase adjustment.

Figure 3:
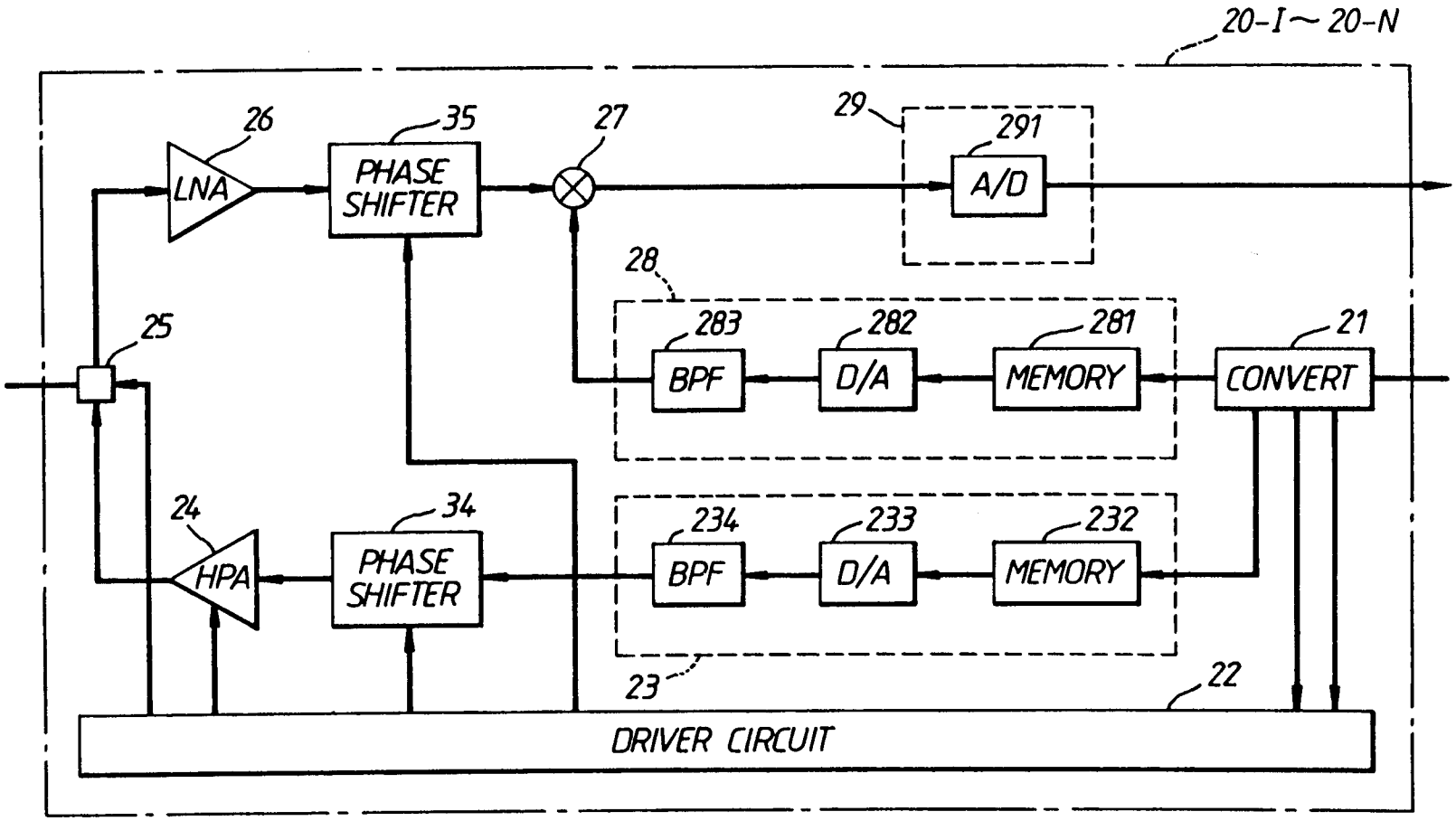
FIG. 3 is a block diagram of a transmitting/receiving module in an apparatus according to a further embodiment of this invention.

Each of transmitting/receiving modules 20 shown in FIG. 3 includes phase shifters 34 and 35 for analog signals. Transmitting signal generator 23 includes a memory 232, a digital to analog converter 233 and a band pass filter 234. Receiving circuit 29 has an analog to digital converter 291. Transmitting signal generator 23 generates a transmitting signal in response to transmitting signal generating data from converter 21. Phase shifter 34 controls the phase of the transmitting signal in accordance with the phase controlling data from driver circuit 22 and transmits the controlled signal to high power amplifier 24. Phase shifter 35 controls the phase of the amplifier signal from low noise amplifier 26 in accordance with the phase controlling data from driver circuit 22. The controlled signal from phase shifter 35 is supplied to mixer 27. The IF signal from mixer 27 is converted into a digital signal, by converter 291 in receiving circuit 29, which is supplied to systolic array processor 41. The arrangement having modules 20 shown in FIG. 3 has almost the same operational effect as the arrangement shown in FIG. 1.

Figure 4:
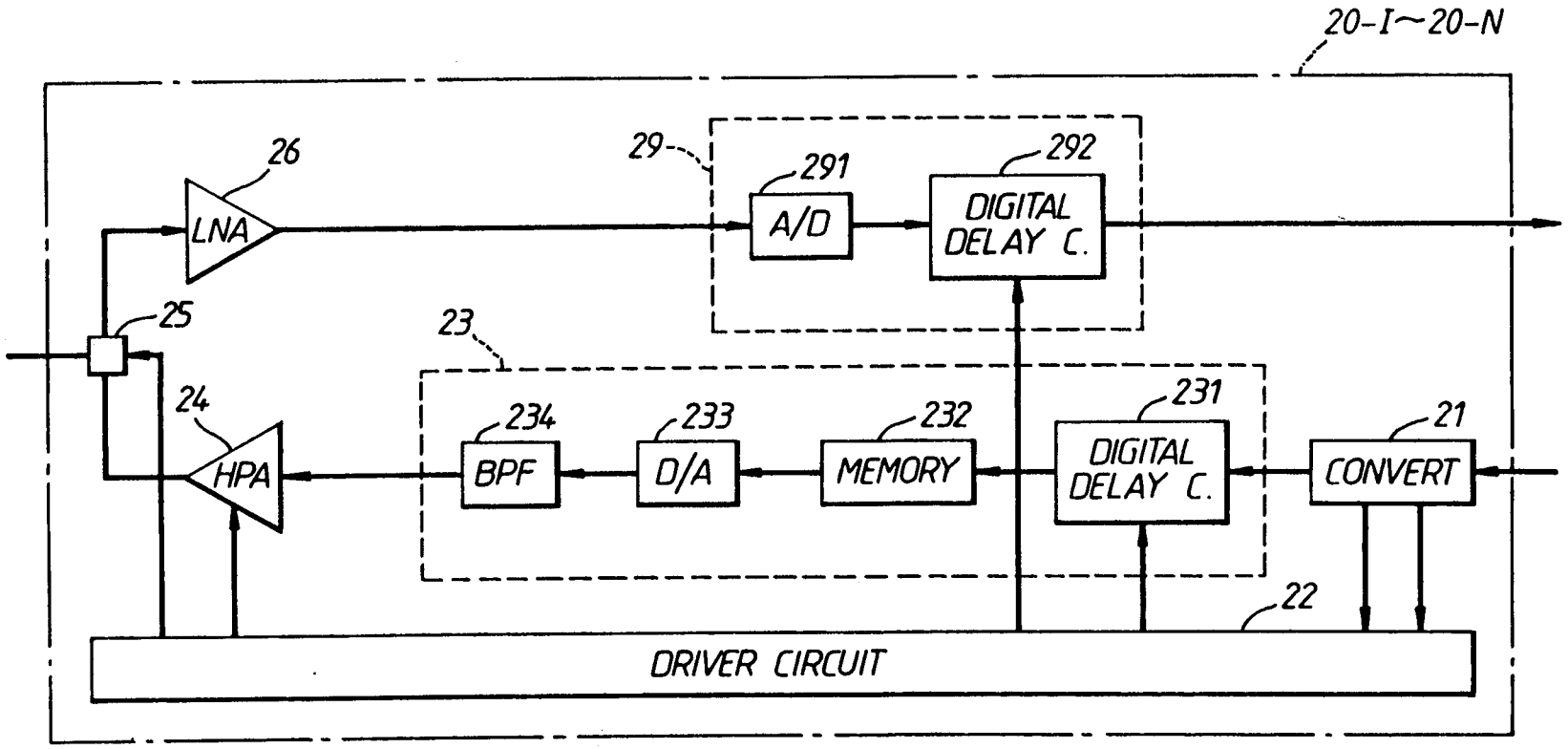
FIG. 4 is a block diagram of a transmitting/receiving module in an apparatus according to still a further embodiment of this invention.
Figure 5:
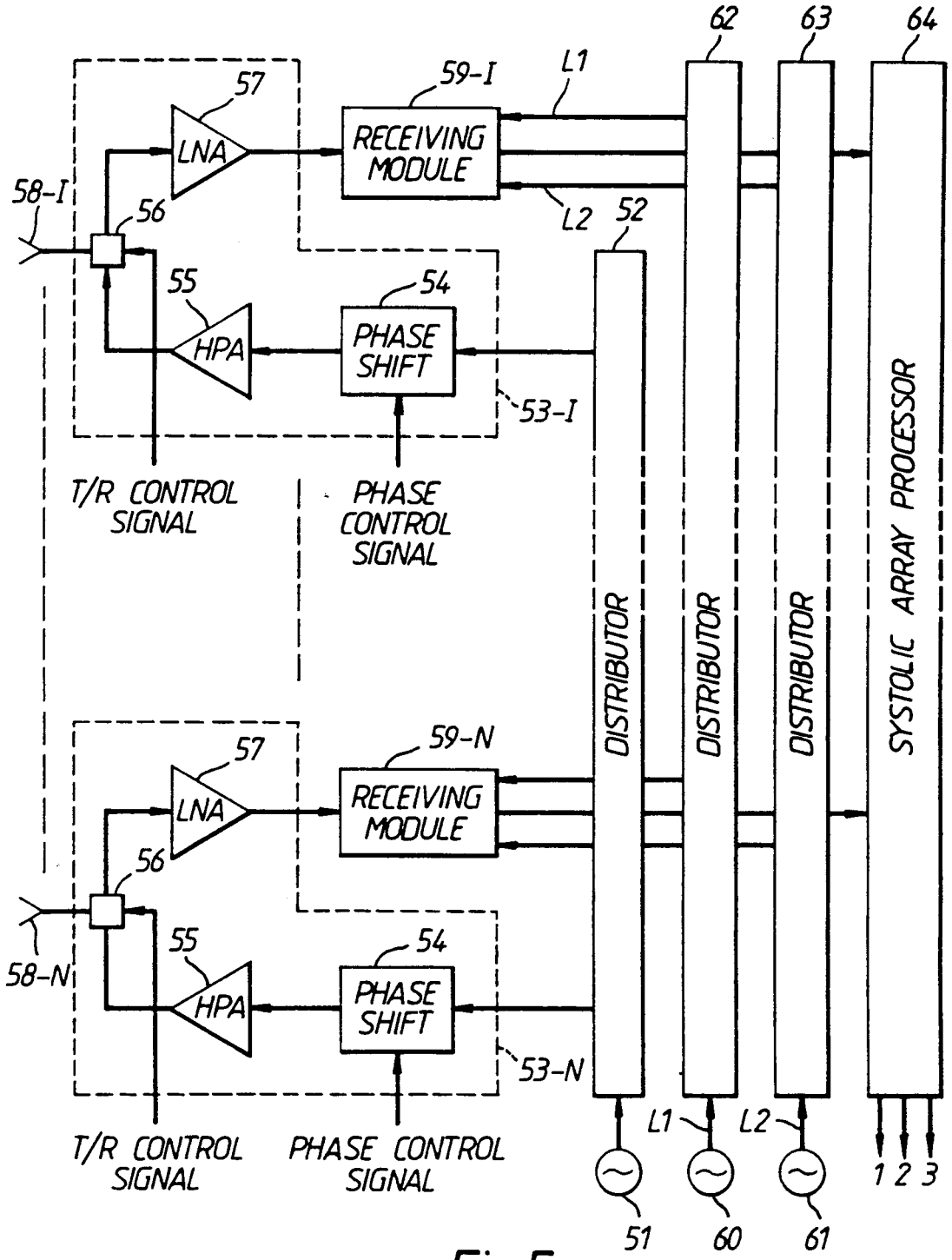
Fig.5. (PRIOR ART)
FIG. 5 is a block diagram of a known array antenna apparatus.

Modules 20 can be formed as shown in FIG. 4. When analog to digital converter 291 can follow a high frequency of the received signal by antenna elements 11, local signal generator 28 and mixer 27 can be removed. The transmitting/receiving modules can be easily formed by integrated circuit which are available for a compact and relatively light apparatus.

Thus this invention provides a simplified arrangement without the need for distributors for high frequency signals. The transmitting/receiving circuits can be easily adjusted. Therefore, the invention provides an improved array antenna apparatus that is suitable for phased array system for performing electronic beam scanning.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A plural element array antenna arrangement, comprising:

producing means for generating a control signal having phase control data and signal generating data, said signal generating data being a clock signal;

plural dividing means corresponding to the plural antenna elements, each dividing means for dividing the control signal into the phase control data and the signal generating data;

plural signal generating means corresponding to the plural antenna elements, each generating means for generating a defined signal having a frequency responsive to the signal generating data, said defined signal being generated in response to a timing signal; and plural driving means corresponding to the plural antenna elements, each driving means for producing a specified signal in response to the defined signal, through each of the antenna elements, each driving means comprising for producing said timing signal is accordance with said phase control data.

2. An arrangement according to claim 1, wherein the producing means includes:

means for generating optically multiplexed signals having the phase control data and the signal generating data; and optical fiber means for transmitting the optically multiplexed signals.

3. An arrangement according to claim 2, wherein the dividing means includes means, connected to the optically multiplexed signals generating means through the optical fiber means, for converting the optically multiplexed signals into electrical signals.

4. An arrangement according to claim 1, wherein the signal generating means comprises:

means for generating second clock signals in response to the signal generating data and the timing signal;

means for storing sampling data which are read in response to the second clock signals; and means for converting digital signals corresponding to the sampling data into analog signals, said defined signal being generated in response to said analog signals.

5. An arrangement according to claim 4, wherein each of the driving means further comprises means for supplying an analog transmitting signal as said specified signal, in response to said defined signal, to the corresponding antenna element.

6. An arrangement according to claim 1, wherein the producing means includes means for generating local signal data.

7. An arrangement according to claim 6, wherein the signal generating means includes means for generating local signals corresponding to the local signal data.

8. An arrangement according to claim 7, wherein the local signal generating means comprises:

means for storing sampling data which are read in response to clock signals corresponding to the local signal data; and means for converting digital signals corresponding to the sampling data into analog signals.

9. An arrangement according to claim 8, wherein each of the driving means comprises:

means for mixing a received signal from the antenna element and the local signal to produce an intermediate frequency signal; and means for producing a digital received signal corresponding to the intermediate frequency signal.

10. A plural element array antenna arrangement comprising:

producing means for generating a first control signal having phase control data and signal generating data, said signal generating data being a first clock signal; and a plurality of antenna modules, each of said antenna modules comprising:

at least one antenna element for transmitting a signal;

dividing means for dividing said first control signal into said phase control and said signal generating data, a driver circuit for generating a timing signal in response to said phase control data, and means for generating a transmitting signal in response to said signal generating data and said timing signal, said transmitting signal being transmitted by said antenna element.

11. An arrangement as recited in claim 10, wherein:

said first control signal from said producing means includes signal controlling data;

said dividing means divides said first control signal into said phase control data, said signal generating data and said signal controlling data;

said driving means generates a second control signal in response to said signal controlling data; and each of said antenna modules further comprises an amplifier for amplifying said transmitting signal from the transmitting signal generating means before said transmitting signal is output by said antenna element, said amplifier amplifying said transmitting signal in response to said second control signal.

12. An arrangement as recited in claim 10, wherein said means for generating a transmitting signal comprises:

digital delay means for generating a second clock signal in response to said signal generating data and said timing signal;

memory means for generating sampling data in response to said second clock signal;

conversion means for generating an analog signal in response to said sampling data; and filtering means for filtering said analog signal and outputting said transmitting signal.

13. An arrangement as recited in claim 12, wherein:

said first control signal from said producing means includes signal controlling data;

said dividing means divides said first control signal into said phase control data, said signal generating data and said signal controlling data;

said driving means generates a second control signal in response to said signal controlling data; and each of said antenna modules further comprises an amplifier for amplifying said transmitting signal from the transmitting signal generating means before said transmitting signal is output by said antenna element, said amplifier amplifying said transmitting signal in response to said second control signal.

14. An arrangement as recited in claim 10, wherein said means for generating a transmitting signal comprises:

memory means for generating sampling data in response to said signal generating data;

conversion means for generating an analog signal in response to said sampling data;

filtering means for filtering said analog signal to output a filtered signal; and means for phase shifting said filtered signal in response to said timing signal and outputting said transmitting signal.

15. An arrangement as recited in claim 14, wherein:

said first control signal from said producing means includes signal controlling data;

said dividing means divides said first control signal into said phase control data, said signal generating data and said signal controlling data;

said dividing means generates a second control signal in response to said signal controlling data; and each of said antenna modules further comprises an amplifier for amplifying said transmitting signal from the transmitting signal generating means before said transmitting signal is output by said antenna element, said amplifier amplifying said transmitting signal in response to said second control signal.

16. A plural element array antenna arrangement comprising:

producing means for generating a first control signal having phase control data and signal generating data, said signal generating data being a first clock signal; and a plurality of antenna modules, each of said antenna modules comprising:

at least one antenna element for detecting a signal;

dividing means for dividing said first control signal into said phase control data and said signal generating data, a driver circuit for generating a timing signal in response to said phase control data, and means for receiving said signal detected by said antenna element and generating a received signal in accordance with said detected signal, said signal generating data and said timing signal.

17. An arrangement as recited in claim 16, further comprising an array processor for processing said received signal detected by each of said antenna elements.

18. An arrangement as recited in claim 16, wherein said antenna module further comprises a low noise amplifier for amplifying said signal detected by said antenna element before received by said receiving means.

19. An arrangement as recited in claim 16, wherein said receiving means comprises:

means for generating a local signal in response to said signal generating data; and a receiving circuit for generating said received signal in response to said local signal, said timing signal and said detected signal.

20. An arrangement as recited in claim 19, wherein said receiving circuit comprises:

means for modulating said detected signal in response to said local signal and outputting a modulated signal;

means for digitizing said modulated signal; and digital delay means for delaying said digitized modulated signal in response to said timing signal and outputting said received signal.

21. An arrangement as recited in claim 19, wherein said receiving circuit comprises:

means for phase shifting said detected signal in response to said timing signal and outputting a phase shifted signal;

means for modulating said phase shifted signal in response to said local signal and outputting a modulated signal; and means for digitizing said modulated signal and outputting said received signal.

22. A plural element array antenna arrangement comprising:

producing means for generating a first control signal having phase control data, signal generating data and signal controlling data, said signal generating data being a first clock signal and including transmitting signal data; and a plurality of antenna modules comprising:

at least one antenna element for transmitting and detecting a signal;

dividing means for dividing the first control signal into said phase control data, said signal controlling data, and said transmitting signal data, a driver circuit for generating a timing signal in response to said phase control data and a second control signal in response to said signal controlling data, means for generating a transmitting signal in response to said transmitting signal data and said timing signal, means for generating a received signal in response to a detected signal and said timing signal, and means for selecting a transmitting mode or a receiving mode for said antenna module in response to said second control signal, said selecting means causing said antenna element to transmit said transmitting signal during said transmitting mode and causing said antenna element to input said detected signal into said received signal generating means during said receiving mode.

23. An arrangement as recited in claim 22, wherein said means for generating a transmitting signal comprises:

digital delay means for generating a second clock signal in response to said transmitting signal data and said timing signal;

memory means for generating sampling data in response to said second clock signal;

conversion means for generating an analog signal in response to said sampling data; and filtering means for filtering said analog signal and outputting said transmitting signal.

24. An arrangement as recited in claim 22, wherein said means for generating a transmitting signal comprises:

memory means for generating sampling data in response to said transmitting signal data;

conversion means for generating an analog signal in response to said sampling data;

filtering means for filtering said analog signal to output a filtered signal; and means for phase shifting said filtered signal in response to said timing signal and outputting said transmitting signal.

25. An arrangement as recited in claim 22, wherein said means for generating a received signal comprises:

means for converting high frequency signals, said converting means digitizing said detected signal and outputting a digitized signal; and digital delay means for delaying said digitized signal in response to said timing signal and outputting said received signal.

26. An arrangement as recited in claim 22, wherein:

said signal generating data includes local signal data;

said dividing means divides said first control signal into said phase control data, said signal controlling data, said local signal data and said transmitting signal data; and said received signal generating means generates said received signal in response to said detected signal, said local signal data and said timing signal.

27. An arrangement as recited in claim 26, wherein said receiving means comprises:

means for generating a local signal in response to said local signal data; and a receiving circuit for generating said received signal in response to said local signal, said timing signal and said detected signal.

28. An arrangement as recited in claim 27, wherein said receiving circuit comprises:

means for modulating said detected signal in response to said local signal and outputting a modulated signal;

means for digitizing said modulated signal; and digital delay means for delaying said digitized modulated signal in response to said timing signal and outputting said received signal.

29. An arrangement as recited in claim 27, wherein said receiving circuit comprises:

means for phase shifting said detected signal in response to said timing signal and outputting a phase shifted signal;

means for modulating said phase shifted signal in response to said local signal and outputting a modulated signal; and means for digitizing said modulated signal and outputting said received signal.

* * * * *